US005611153A

United States Patent [19]

Fisher et al.

[11] Patent Number: 5,611,153

[45] Date of Patent: Mar. 18, 1997

[54] INSOLE FOR HEEL PAIN RELIEF

[75] Inventors: Randall K. Fisher, Germantown; Donald B. Thompson, Memphis, both of Tenn.

[73] Assignee: Schering-Plough Healthcare Products, Inc., Memphis, Tenn.

[21] Appl. No.: 390,159

[22] Filed: Feb. 17, 1995

Related U.S. Application Data

[63] Continuation-in-part of Ser. No. 241,948, May 12, 1994, abandoned.

[51] Int. Cl.[6] ..... A43B 13/38; A43B 7/14

[52] U.S. Cl. ..... 36/43; 36/173; 36/178; 36/181; 36/71; 36/80

[58] Field of Search ..... 36/43, 44, 145, 36/154, 173, 174, 178, 180, 181, 71, 80

[56] References Cited

U.S. PATENT DOCUMENTS

| | | | |
|---|---|---|---|
| D. 259,675 | 6/1981 | Gordon et al. . | |
| D. 302,624 | 8/1989 | Thompson et al. . | |
| D. 336,718 | 6/1993 | Schroer, Jr. . | |
| D. 367,164 | 2/1996 | Fisher et al. | D2/961 |
| 1,055,768 | 3/1913 | Levee et al. . | |
| 1,244,027 | 12/1917 | Calvey . | |
| 1,508,110 | 9/1924 | Mayer . | |
| 2,008,207 | 7/1935 | Greenberg . | |
| 2,348,300 | 5/1944 | Klaus . | |
| 2,379,366 | 6/1945 | Lumbard . | |
| 2,403,442 | 7/1946 | Klaus . | |
| 2,409,960 | 10/1946 | Scholl . | |
| 2,426,735 | 9/1947 | Hiss | 36/43 |
| 2,598,782 | 6/1952 | Gillis . | |
| 2,599,317 | 6/1952 | Brady . | |
| 2,826,834 | 3/1958 | Ratcliff . | |
| 2,865,097 | 12/1958 | Vollrath, Jr. et al. | 36/43 |
| 2,924,849 | 2/1960 | Buchman . | |
| 3,068,872 | 12/1962 | Brody . | |
| 3,244,176 | 4/1966 | Neu . | |
| 3,266,178 | 8/1966 | Gilkerson | 36/43 |
| 3,300,880 | 1/1967 | Campagna . | |
| 3,306,300 | 2/1967 | Van Kleef | 36/178 |
| 3,309,797 | 3/1967 | Poitras . | |
| 3,333,353 | 8/1967 | Garcia . | |
| 3,466,763 | 9/1969 | Levin . | |
| 3,530,489 | 9/1970 | Appleton . | |
| 3,545,447 | 12/1970 | Silverman . | |
| 3,616,170 | 10/1971 | Closson, Jr. et al. . | |
| 3,638,336 | 2/1972 | Silverman . | |
| 3,825,017 | 7/1974 | Scrima | 36/44 |
| 4,084,333 | 4/1978 | Del Vecchio . | |
| 4,124,946 | 11/1978 | Tomlin | 36/43 |
| 4,232,457 | 11/1980 | Mosher | 36/44 |
| 4,325,380 | 4/1982 | Malkin . | |
| 4,346,525 | 8/1982 | Larsen et al. . | |
| 4,435,910 | 3/1984 | Marc . | |
| 4,510,699 | 4/1985 | Nakamura et al. | 36/43 |

(List continued on next page.)

FOREIGN PATENT DOCUMENTS

| | | | |
|---|---|---|---|
| 588504 | 12/1959 | Canada . | |
| 73542 | 12/1993 | Canada . | |
| 4006050 | 8/1990 | Germany | 36/43 |
| 447194 | of 1933 | United Kingdom . | |
| 1007152 | 5/1991 | WIPO | 36/154 |

OTHER PUBLICATIONS

H. J. Hillstrom, K. Whitney, J. McGuire, H. Palamarchuk, W. Ledoux, J. Song, S. Bhimji, I. Friedman, C. Weikert and F. Kugler, "Biomechanical Assay of a Specially Designed Insole for Plantar Fasciitis/Heel Spur Syndrome," *Journal of Gait and Posture,* vol. 4, No. 2, p. 195, Apr. 1996, Elsevier Science Ireland Ltd.

*Primary Examiner*—Marie D. Patterson
*Attorney, Agent, or Firm*—Joseph T. Majka

[57] ABSTRACT

An insole and a method for relieving bottom-of-heel pain (ie. plantar heel pain) and/or arch pain associated with bottom-of-heel pain is described.

21 Claims, 8 Drawing Sheets

U.S. PATENT DOCUMENTS

| | | | |
|---|---|---|---|
| 4,510,700 | 4/1985 | Brown . | |
| 4,517,981 | 5/1985 | Santopietro et al. | 36/43 |
| 4,522,777 | 6/1985 | Peterson | 36/154 |
| 4,530,173 | 7/1985 | Jesinsky, Jr. . | |
| 4,541,186 | 9/1985 | Mulvihill | 36/43 |
| 4,580,356 | 4/1986 | David | 36/43 |
| 4,619,056 | 10/1986 | Lin et al. | 36/43 |
| 4,627,178 | 12/1986 | Sullivan et al. . | |
| 4,677,766 | 7/1987 | Gudas | 36/43 |
| 4,686,993 | 8/1987 | Grumbine | 36/80 |
| 4,694,589 | 11/1987 | Sullivan et al. . | |
| 4,702,255 | 10/1987 | Schenkl | 36/91 |
| 4,747,410 | 5/1988 | Cohen . | |
| 4,759,357 | 7/1988 | Allart et al. . | |
| 4,776,109 | 10/1988 | Sacre | 36/3 B |
| 4,791,736 | 12/1988 | Philips | 36/43 |
| 4,793,078 | 12/1988 | Andrews . | |
| 4,841,648 | 6/1989 | Shaffer et al. . | |
| 4,910,886 | 3/1990 | Sullivan et al. . | |
| 5,174,052 | 12/1992 | Schoenhaus et al. . | |
| 5,187,885 | 2/1993 | Murphy | 36/43 |
| 5,282,326 | 2/1994 | Schroer, Jr. et al. . | |
| 5,327,664 | 7/1994 | Rothbart | 36/174 |

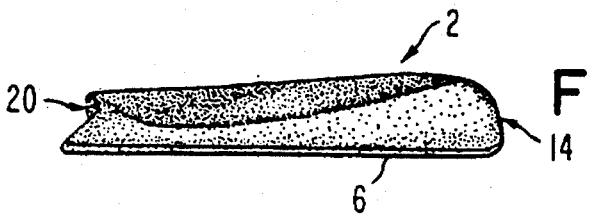
FIG. 6
FIG. 7
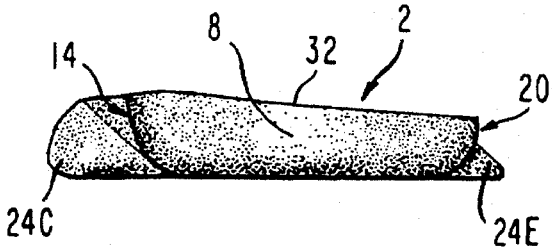
FIG. 8
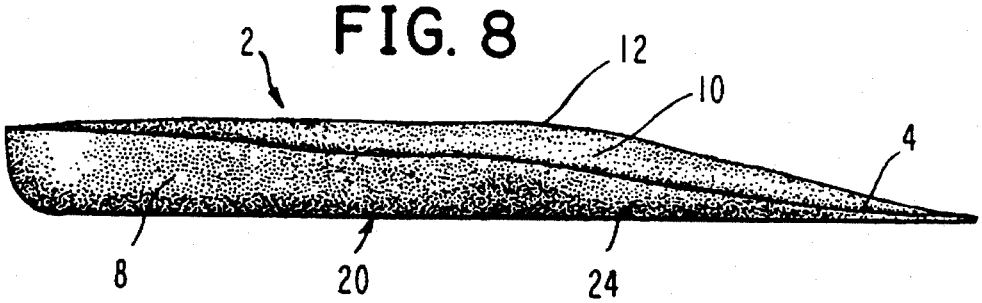
FIG. 9
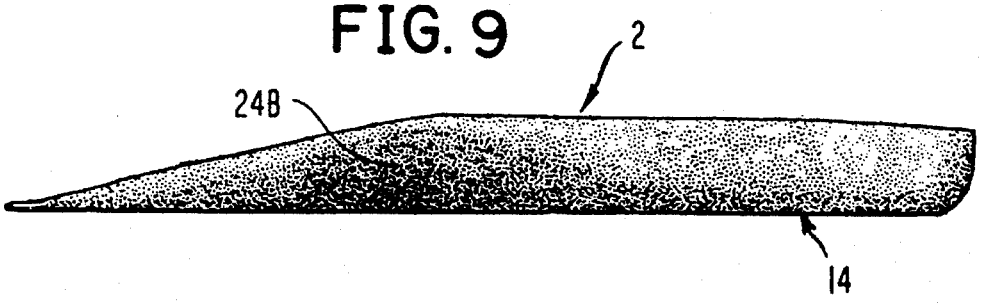

INSOLE FOR HEEL PAIN RELIEF

CROSS-REFERENCES TO RELATED APPLICATIONS

This application is a continuation-in-part of U.S. patent application Ser. No. 08/241,948 filed May 12, 1994, now abandoned. This application is related to pending U.S. patent application Ser. No. 29/018,808 filed Feb. 16, 1994, titled "Heel Insole" and pending U.S. patent application Ser. No. 29/022,800 filed May 12, 1994, also titled "Heel Insole" issued Feb 20, 1996 as U.S. Pat. No. Des. 367,164.

BACKGROUND OF THE INVENTION

The present invention relates to a novel insole for footwear especially useful for relieving heel pain.

Pain on the bottom or side borders of the heel of the foot (in the center bottom, lower sides, or front of the heel) is known as plantar heel pain or bottom-of-heel pain. Such pain can be caused by various diseases such as arthritis, gout or diabetes or by several mechanically induced causes. The mechanical causes include such factors as plantar fasciitis, heel spurs, heel bruises, thinning or loss of fat from the fat pad on the bottom of the heel (the body's own natural heel cushion), strains, bursitis, nerve entrapment, or stress from high and rigid arches. Plantar faciitis is an inflammation of the plantar fascia (a fibrous sheath that encapsulates the ligament that runs along the bottom of the foot) near the point where it attaches to the front surface of the calcaneous or heel bone. The inflammation is believed to be caused by microtears of the plantar fascia caused by excessively stretching and/or twisting of the plantar fascia. Heel spurs are calcium deposits which grow on the front of the calcaneus and stick out into the plantar fascia and irritate this sensitive heel tissue. Further, arch pain often accompanies or is associated with bottom-of-heel pain. Such arch pain can arise from a sufferer's attempt to alleviate or minimize the bottom-of-heel pain by an abnormal walking gait. A search of the literature over the past 20 years uncovered very few patents which even addressed the subject of plantar heel pain. Generally, the theraputic approach has required the use of rigid prescription (i.e. custom-fitted) orthotic with a thin topcover to control foot motion. Accordingly, research was conducted to develop an insole which would relieve planter heel pain from the various mechanical causes or factors and could be mass-produced in a select number of sizes to fit the general population.

SUMMARY OF THE INVENTION

The present invention is directed towards a removable insole for relieving bottom-of-heel pain and/or arch pain associated with bottom-of-heel pain comprising:

a flexible, shock-absorbing material having a front portion with a forward edge, a cupped heel portion and a broad, raised arch portion having a maximum height at the medial edge of said insole; wherein said front portion tapers downward from said raised arch portion toward a first minimum thickness on a line positioned behind the metatarsal heads of a foot when the insole is in place in a shoe;

said cupped heel portion is posted medially from about 1 to about 4 degrees so that the medial bottom side of said cupped portion is thicker than the lateral bottom side of said cupped portion;

said insole has a substantially upright wall portion which extends arcuately around said cupped heel portion, wherein starting at the heel end, said wall portion gradually slopes inward on the medial side (as the wall portion proceeds toward the front portion) at a decreasing angle from horizontal to a point approximately one-third across the width of the insole, and continues forward while reducing in height along said medial edge to undercut said arch portion and allow a close fit of the undercut arch portion with the arch portion of a shoe, wherein on the lateral side of said insole, said upright wall portion reduces in height from said cupped heel portion to said first minimum thickness in the front portion;

said broad, raised arch portion gradually slopes downward from said maximum point to said first minimum thickness on a line behind the metataral heads, to a second minimum thickness at about 55 to about 90 percent across said insole width from said maximum, raised arch portion and to a third minimum thickness within said cupped heel portion.

Preferably, the second minimum thickness is about 65 to about 85 percent across said insole width from said maximum raised arch portion, more preferably about 75 to about 80 percent.

In another embodiment, the present invention is directed towards a method for relieving bottom-of-heel pain, arch pain associated with bottom-of-heel pain or both types of pain by wearing a removeable insole or by providing a removeable insole to a person experiencing said pain for wearing in the person's shoes, wherein the insole comprises:

a flexible, shock-absorbing material having a front portion with a forward edge, a cupped heel portion and a broad, raised arch portion having a maximum height at the medial edge of said insole; wherein said front portion tapers downward from said raised arch portion toward a first minimum thickness on a line positioned behind the metatarsal heads of a foot when the insole is in place in a shoe;

said cupped heel portion is posted medially from about 1 to about 4 degrees so that the medial bottom side of said cupped portion is thicker than the lateral bottom side of said cupped portion;

said insole has a substantially upright wall portion which extends arcuately around said cupped heel portion, wherein starting at the heel end, said wall portion gradually slopes inward on the medial side (as the wall portion proceeds toward the front portion) at a decreasing angle from horizontal to a point approximately one-third across the width of the insole, and continues forward while reducing in height along said medial edge to undercut said arch portion and allow a close fit of the undercut arch portion with the arch portion of a shoe, wherein on the lateral side of said insole, said upright wall portion reduces in height from said cupped heel portion to said first mininum thickness in the front portion;

said broad, raised arch portion gradually slopes downward from said maximum point to said first minimum thickness on a line behind the metataral heads, to a second minimum thickness at about 55 to about 90 percent across said insole width from said maximum, raised arch portion and to a third minimum thickness within said cupped heel portion.

One advantage of the present invention is that it can provide a lightweight insole that can relieve plantar heel pain resulting from its major mechanical causes, such as plantar fasciitis, heel spurs, thinning fat pad, heel bruises, calluses or high arches.

A second advantage of the present insole is that it provides cushioning and shock absorption for sore, sensitive heels.

A third advantage is that the present insole can be readily used to support and cushion normal feet in footwear that have little or no arch support.

A fourth advantage is that the present insole has been sized to fit most footwear styles for men and women so that it feels like part of the shoe.

A fifth advantage of the present insole is that because its design allows the insole or insert to fill the void space between the foot and the shoe, the present insole feels less bulky than other insole products having substantial arch supports. Thus, the present insole can be comfortably worn by the user with the user's normal size footwear without the need to resort to larger footwear sizes.

A sixth advantage is that the present insole can be mass produced at a significantly lower cost than individually fitted custom orthotics.

DESCRIPTION OF THE PREFERRED EMBODIMENTS

In the present specification, the terms "insole", "innersole" or "insert" are considered to be synonymous and interchangeable.

In the following discussions, the preparative teachings of any patents disclosed herein are incorporated herein by reference. Preferably, the shock-absorbing portion of the insole is one piece, meaning that this portion is of unitary construction. Alternatively, the shock-absorbing portion can be of laminate construction made of separate distinct components or layers.

The present insole can be made to be three quarter length to full length, preferably three quarter length. Three quarter length refers to the length extending from the heel to the first metatarsals of the foot, whereas full length refers to the entire length of the foot.

A topcover can be bonded to the outer surface of the toe portion, the cupped heel portion and/or the broad, raised arch portion. The topcover can be prepared from, but not limited to, materials, such as fabrics, leather, leatherboard, expanded vinyl foam, flocked vinyl film, coagulated polyurethane, latex foam on scrim, supported polyurethane foam, laminated polyurethane film or in-mold coatings such as polyurethanes, styrene- butadiene-rubber, acrylonitrile-butadiene, acrylonitrile terpolymers and copolymers, vinyls, or other acrylics, as integral topcovers. Desirable characteristics of the topcover include good durability, stability and visual appearance. Also desired is that the topcover material have good flexibility, as indicated by a low modulus, in order to be easily moldable. The bonding surface of the topcover should provide an appropriate texture in order to achieve a suitable mechanical bond to the insole. Preferably, the topcover material is a fabric, such as a brushed knit laminate topcloth (brushed knit fabric/urethane film/nonwoven scrim cloth laminate) or a urethane knit laminate topcloth.

The insole can be prepared from any flexible material which can cushion and absorb the shock from heel strike on the insole. Suitable shock absorbing materials can include any suitable foam, such as but not limited to: cross-linked polyethylene, poly(ethylene-vinyl acetate), polyvinyl chloride, synthetic and natural latex rubbers, neoprene, block polymer elastomer of the acrylonitrile-butadiene-styrene or styrene-butadienestyrene type, thermoplastic elastomers, ethylenepropylene rubbers, silicone elastomers, polystyrene, polyurea or polyurethane; most preferably a polyurethane foam made from flexible polyol chain and an isocyanate such as a monomeric or prepolymerized diisocyanate based on 4,4'-diphenylmethane diisocyanate (MDI) or toluene diisocyanate (TDI). Such foams can be blown with freon, water, methylene chloride or other gas producing agents, as well as by mechanically frothing to prepare the shock absorbing resilient layer. Such foams advantageously can be molded into the desired shape or geometry. Non-foam elastomers such as the class of materials known as viscoelastic polymers, or silicone gels, which show high levels of damping when tested by dynamic mechanical analysis performed in the range of −50° C. to 100° C. may also be advantageously employed. U.S. Pat. Nos. 3,489,594, 4,722,946 and 4,476,258 describe suitable energy absorbing polyurethane foam compositions. A resilient polyurethane can be prepared from diisocyanate prepolymer, polyol, catalyst and stabilizers which provide a waterblown polyurethane foam of the desired physical attributes. Suitable diisocyanate prepolymer and polyol components include polymeric MDI M-10 (CAS 9016-87-9) and Polymeric MDI MM-103 (CAS 25686-28-6), both available from BASF, Parsippany, N.J.; Pluracol 945 (CAS 9082-00-2) and Pluracol 1003, both available from BASF, Parsippany, N.J.; Multrinol 9200, available from Mobay, Pittsburgh, Pa.; MDI diisocyanate prepolymer XAS 10971.02 and polyol blend XUS 18021.00 available from the Dow Chemical Company, Midland, Mich.; and Niax 34–28, available from Union Carbide, Danbury, Conn. These urethane systems generally contain a surfactant, a blowing agent, and an ultra-violet stabilizer and/or catalyst package. Suitable catalysts include Dabco 33-LV (CAS 280-57-9,2526-71-8), Dabco X543 (CAS Trade Secret), Dabco T-12 (CAS 77-58-7), and Dabco TAC (CAS 107-21-1) all obtainable from Air Products Inc., Allentown, Pa.; Fomrez UL-38, a stannous octoate, from the Witco Chemical Co., New York, N.Y. or A-1(CAS 3033-62-3) available from OSI Corp., Norcross, Ga. Suitable stabilizers include Tinuvin 765 (CAS 41556-26-7), Tinuvin 328 (CAS 25973-55-1), Tinuvin 213 (CAS 104810-48-2), Irganox 1010 (CAS 6683-19-8), Irganox 245 (CAS 36443-68-2), all available from the Ciba Geigy Corporation, Greensboro, N.C., or Givsorb UV-1 (CAS 057834-33-0) and Givsorb UV-2 (CAS 065816-20-8) from Givaudan Corporation, Clifton, N.J. Suitable surfactants include DC-5169 (a mixture), DC190 (CAS68037-64-9), DC197 (CAS69430-39-3), DC-5125 (CAS 68037-62-7) all available from Air Products Corp., Allentown Pa. and L-5302 (CAS trade secret) from Union Carbide, Danbury Conn. Alternatively, the present insole can be a laminate construction (ie. multilayered composite) of any of the above materials. Multilayered composites are made from one or more of the above materials such as a combination of polyethylene vinyl acetate and polyethylene (two layers), a combination of polyurethane and polyvinyl chloride (two layers) or a combination of ethylene propylene rubber, polyurethane foam and ethylene vinyl acetate (3 layers). Measurements of the shock-absorbing capabilities of the materials can be made using any suitable method, such as by using an impact tester and/or a ball rebound tester.

The bottom of the insole can be treated with adhesives or materials having a high coefficient of friction, or velcro-type fasteners to provide non-slip features or semi-permanent attachment of the device in the shoe. For example, a high peel, high shear, double sided pressure sensitive adhesive tape, such as 443 PC Tape of the 3M Company, St. Paul, Minn., could be used to fasten the insole to an article of footwear. Such adhesives should not come in direct contact on a regular basis with peoples feet.

Alternatively, the bottom layer and/or undercut can be coated with a a non-slip, acrylic coating which has a low coefficient of friction, described in "Method for Preparing Molded Innersoles Having a Non-Slip Surface," Ser. No. 08/112,505, filed Aug. 26, 1993, whose preparative teachings are incorporated herein by reference. The non-slip coating can be pre-applied to a bottom mold cavity prior to adding a polyurethane mixture. The coating molds integrally to the resultant polyurethane foam layer.

The table below summarizes characteristics of a range of materials which can be employed in the innersole of the present invention. One of ordinary skill in the art will appreciate that the characteristics of the innersole can vary from portion to portion and within each layer. For example, within the heel portion, toe portion and intermediate arch portion the thickness, hardness, density, etc. of each layer can vary within the layer.

| | TOPCOVER LAYER | SHOCK ABSORBING LAYER | BOTTOM COATING OR LAYER (OPTIONAL) | OVERALL INSOLE (COMBINED LAYERS) |
|---|---|---|---|---|
| THICKNESS | | | | |
| inches | 0–0.25 | 0.005–0.95 | 0–0.25 | 0.005–1.0 |
| centimeter | 0–0.635 | 0.013–2.413 | 0–0.635 | 0.013–2.54 |
| HARDNESS | | | | |
| Shore 00 durometer | — | 20 to 100 units | — | 20 to 100 units |
| DENSITY[1] | | | | |
| lb/cu. ft. | — | 2–35 | — | 2–40 |
| g/cc | — | 0.032–0.561 | — | 0.032–0.641 |
| COMPRESSION LOAD DEFLECTION | — | At 25% compression | — | At 25% compression |
| lb/sq. in. | — | 5–50 | — | 5–50 |
| kg/sq. cm | — | 35.1–352 | — | 35.1–352 |

[1]Density of innersole can vary from portion to portion and within each layer.

Compression Load Deflection can be measured using ASTM D3574- 86, Test method C at 25% or 50% deflection.

The innersole of the present invention can be prepared by conventional methods such as heat sealing, ultasonic sealing, radio frequency sealing, lamination, thermoforming, reaction injection molding, open cast molding and compression molding and, if necessary, followed by secondary die-cutting or in-mold die cutting. Representative methods are taught, for example, in U.S. Pat. Nos. 3,489,594; 3,530, 489 4,257,176; 4,185,402; 4,586,273, in the Handbook of Plastics, Herber R. Simonds and Carleton Ellis, 1943, New York, N.Y., Reaction Injection Molding Machinery and Processes, F. Melvin Sweeney, 1987, New York, N.Y., and Flexible Polyurethane Foams, George Woods, 1982, New Jersey, whose preparative teachings are incorporated herein by reference. For example the insole can be prepared by a foam reaction molding process such as taught in U.S. Pat. No. 4,694,589.

During use, the insole is placed in a shoe so that the medial side containing the raised arch portion rests against the inside of the shoe. The front portion may end just in front of the metatarsals. For a three quarter length insole, if the front portion ends directly under the metatarsals, the front portion can be trimmed along optional trim lines so that the front portion edge ends behind the metatarsal heads of the foot when the insole is in place in a shoe. For a full length insole, the front portion can be trimmed so that the toe portion fits within the toe portion of a shoe. Optionally, a double sided pressure sensitive adhesive tape can be used to reduce slippage by attaching the tape to the bottom of each insole and pressing the insole with the tape firmly into the shoe.

BRIEF DESCRIPTION OF THE DRAWINGS

In the following Figures, FIGS. 1–10 depict an insole for use with the right foot.

FIG. 1 is a top front perspective view of a three-quarter length insole.

FIG. 2 is a top plan view of the insole of FIG. 1.

FIG. 3 is a contour map of the top surface of the insole of FIG. 2.

FIG. 6 is a front end view of the insole of FIG. 1.

FIG. 7 is a rear end view of the insole of FIG. 1.

FIG. 8 is a view taken along the lateral side of the insole of FIG. 1.

FIG. 9 is a view taken along the medial side of the insole of FIG. 1.

FIG. 10 is a top plan view of a full length insole for use on a right foot.

In FIG. 1, insole 2 has a front portion 4 with a forward leading edge 6, a cupped heel portion 8 and a broad, raised arch portion 10 having a maximum height 12 at the medial side 14 of insole 2. Optionally, and preferably, insole 2 has a small lateral arch portion 18 which leads into the second minimum thickness from lateral side 20. Small lateral arch portion 18 enables the insole to better fit the bottom surface of the foot. Insole 2 is also shown with optional perforations 15, whose number and pattern can be fashioned into any desired configuration.

In FIGS. 2 and 3 are shown designated points a, b and c on medial side 14 and corresponding points a', b' and c' on lateral side 20 of of insole 2. A line connecting points a and a' (ie. a–a') corresponds to a cross sectional slice (as shown in FIG. 4A) taken across the front portion of the insole with minimum thickness at "s" which corresponds to the intersection with the first minimum thickness on a line E–E' just behind the metatarsal heads of a foot when insole 2 is in place in a shoe. A line connecting points b and b' (ie. b–b') corresponds to a cross sectional slice (as shown in FIG. 4B) taken across the maximum height 12 of the arch portion through the second minimum thickness at "u" to the lateral side 20 of insole 2. The second minimum thickness corresponds to the bottom of the valley between arch portion 12 and the small lateral arch portion 18 in FIG. 1. A line connecting points c and c' (ie. c–c') corresponds to a cross sectional slice (as shown in FIGS. 4C and 4D) taken across heel portion 8 through the third minimum thickness at "v" at the bottom of cupped heel portion 8.

In FIG. 3 is shown a contour map of the top surface of insole 2. Each solid line represents portions of the insole surface which are approximately at the same height. For example, line z indicates that this portion of the insole surface extends from the front toe portion, around the raised arch portion and within the cupped heel portion at approximately the same height. Generally, the closer the lines, the greater or steeper is the slope of the contour. Conversely, the further the lines are apart, the lesser or more gradual is the slope. For example, contours tend to be steepest near points c and c' on the upright wall portion of cupped heel 8. Contours tend to be least near points a and a' at the forward portion 4, especially nearer to forward edge 6.

FIGS. 4A, 4B, 4C and 4D show cross sectional views of the insoles of FIGS. 2 and 3 taken across points a–a', b–b' and c–c', also in view of FIG. 5A and 5B. FIG. 4A shows a cross sectional view of tapered front portion 4. The minimum thickness at "s" corresponds to the point of intersection between line a–a' and the line representing the first minimum thickness, E–E' as depicted in FIG. 2. positioned behind the metatarsal heads of a foot when the insole is in place in a shoe.

FIG. 4B shows that arch portion 10 has a maximum arch height t–t' at medial side 14. Arch portion 10 slopes downward to a second minimum thickness at "u" which can be about 55 to about 90 percent across the insole width from a perpendicular drop to point w at the edge of maximum arch height t–t'. Second minimum thickness at "u" is shown to be about 75 percent across the width of insole 2 as measured from point w. From second minimum thickness at "u", the top surface of the insole slopes upward toward lateral side 20 indicated at point b'. FIG. 4B also shows that wall portion 24 gradually slopes inward from medial side 14 at a decreasing angle from horizontal to a point w' approximately one-third across the width of the insole from point w.

FIG. 4C shows the medial posting formed by making the medial bottom side x–x' substantially thicker than the lateral bottom side y–y', so that when worn, the heel of the foot is posted medially from about 1 to about 4 degrees, more preferably from about 2 to 3 degree, and as shown in FIGS. 4C and 4D to be at about 2 ½ degrees. FIG. 4C also shows how the broad arch portion has decreased to a third minimum thickness at "v" within cupped heel portion 8. Generally, second minimum thickness at "u" in arch portion 10 can be greater than or the same as third minimum thickness at "v" in heel portion 8, and either thickness at "u or v" is greater than the first minimum thickness along line E–E' in forward portion 4.

FIG. 4D shows the same cross section as FIG. 4C through heel portion 8 through third minimum thickness at "v". Line RP' represents a line passing through the bottom of the insole and starting at a point P', which is a, point directly vertically below point c'. MM' is a line tangent to the top heel cup surface at its center point Q, which is midway horizontally between vertical lines passing through c and c'. Line PP' is a line parallel to line MM' and passing through point P'. The degree of posting, represented by the angle alpha ($\alpha$) is represented by the angle formed between lines PP' and RP'. As a result of the posting, third minimum thickness at "v" is moved laterally away from midpoint Q.

FIG. 5A shows a bottom rear end view of insole 2 having a substantially upright wall portion 24 which extends arcuately around cupped heel portion 8. On medial side 14, wall portion 24 gradually slopes inward from 24A to 24B at a decreasing angle from horizontal to approximately one-third across the width of the insole to point w' and continues forward to 24C while reducing in height on said medial side 14 to undercut arch portion 10 (not shown), in order to allow a close fit of undercut portion 24B with the arch portion of a shoe. On lateral side 20, wall portion 24 gradually reduces in height from the cupped heel portion 8 from 24D to near the first minimum thickness at line E–E' in the toe portion at 24E. Also shown is a flat bottom surface 30 which rests upon the shoe sockliner or inside bottom surface.

FIG. 5B shows a bottom plan view of insole 2 in which trimlines 22 represent lines in front portion 4 for trimming to a more comfortable fit in a shoe. Generally, forward edge 6 of front portion 4 should be positioned either behind or in front of the metatarsal heads of the user's foot. The placement of forward edge 6 directly beneath the metatarsal heads may cause discomfort to the user. In FIG. 5B shows the preferred embodiment in which forward edge 6 ends just in front of the metatarsal heads. If the forward edge ends directly beneath the metatarsal heads on a user's foot, the trimlines provide the pattern for properly trimming forward portion 4. In this figure, point w', undercut 24B, medial side 14, medial wall portion 24A, lateral wall portion 24D, lateral side 20 and flat bottom 30 are also illustrated.

FIG. 6 shows a front end view of insole 2 in which front edge 6, medial side 14 and lateral side 20 are depicted.

FIG. 7 shows a rear end view of insole 2 in which the rear edge 32 is the top edge of the back of heel cup portion 8 together with lateral side 20 and medial side 14. Point 24C depicts the front of the wall portion on the medial side of the insole's forward portion, while point 24E depicts the front of the wall portion on the lateral side in the forward portion of the insole.

FIG. 8 shows a view taken along the lateral side of insole 2 in which wall portion 24 on lateral side 20 reduces in height from the cupped heel portion 8 to the forward edge in forward portion 4. Point 12 depicts the peak or maximum height of arch portion 10.

FIG. 9 shows a view taken along the medial side 14 having undercut 24B beneath arch 10 (not shown) of insole 2.

FIG. 10 is a top plan view of a full length insole 40 for use on a right foot in which extended forward portion 42 extends into the toe area of a shoe. Arch portion 10 and cupped heel portion 8 are also depicted.

FIG. 11 is a view of the bottom of a foot 50 (conceptually with forward edge 6 of insole 2 in place) to show how forward edge 6 can be positioned relative to metatarsal heads 44*a*, 44*b*, 44*c*, 44*d* and 44*e* (collectively 44). Forward edge 6 of insole 2 can be positioned either behind metatarsal heads 44 along line 6*a*. Alternatively, forward edge 6 can be positioned in front of metatarsal heads 44 along line 6*c*. However, the positioning of the forward edge directly beneath metatarsal heads 44 along line 6*b* may cause discomfort to the user.

FIG. 12 is a view of the side of foot 50 atop insole 2, showing how the forward edge can positioned either behind metatarsal heads 44 at location 6*a* or in front of metatarsal heads 44 at location 6*c*. However, positioning of the forward edge directly beneath metatarsal heads 44 at location 6*b* may cause discomfort to the user.

FIG. 13 is a cross sectional view for FIG. 4C showing additionally, a top cover 46 bonded to the outer surface of the cupped heel portion 8. Optionally, a double sided pressure sensitive adhesive 48 can be fastened to bottom 30 to attach the insole to an article of footwear.

FIG. 14 is a cross sectional view for FIG. 4C showing a multilayered composite of three layers 52*a*, 52*b*, 52*c*.

FIG. 15 is a cross sectional view for FIG. 4C showing additionally, top cover 46 bonded to the outer surface of cupped heel portion 8, a multilayered composite of layers 52*a*, 52*b* and 52*c*, and a double sided adhesive 48 fastened to bottom 30.

Figure 1:
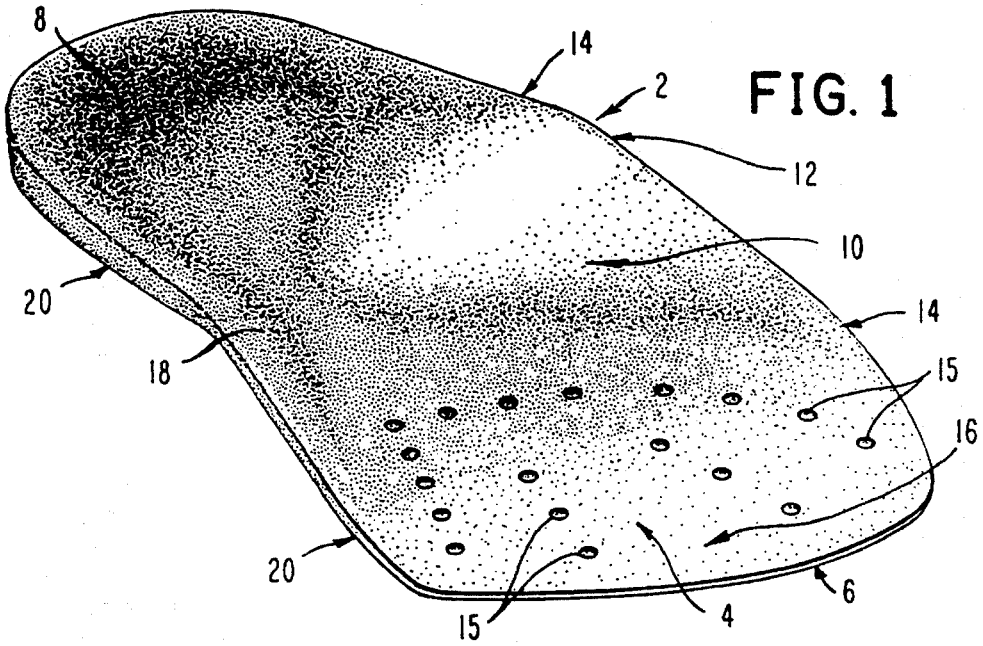
Figure 2:
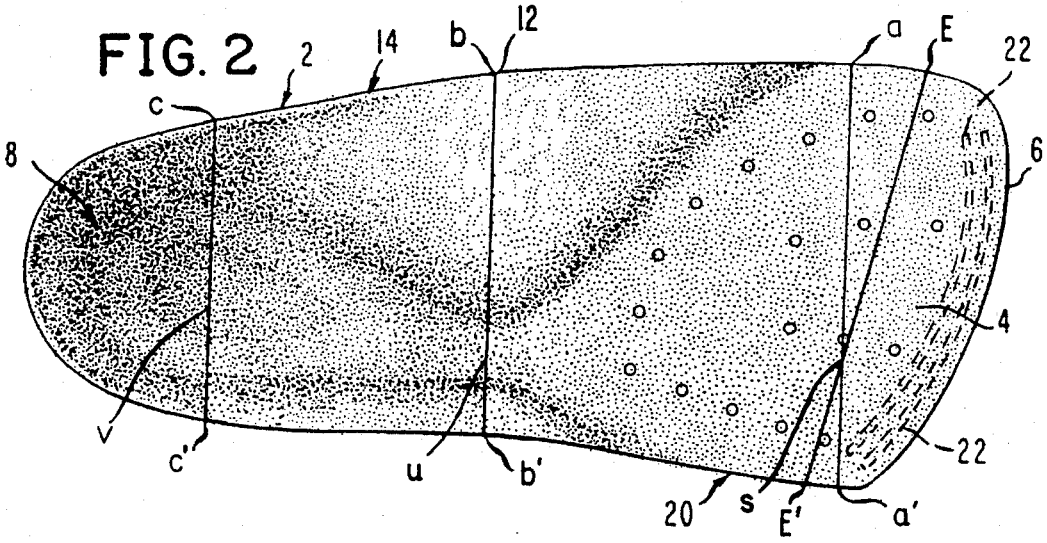
Figure 3:
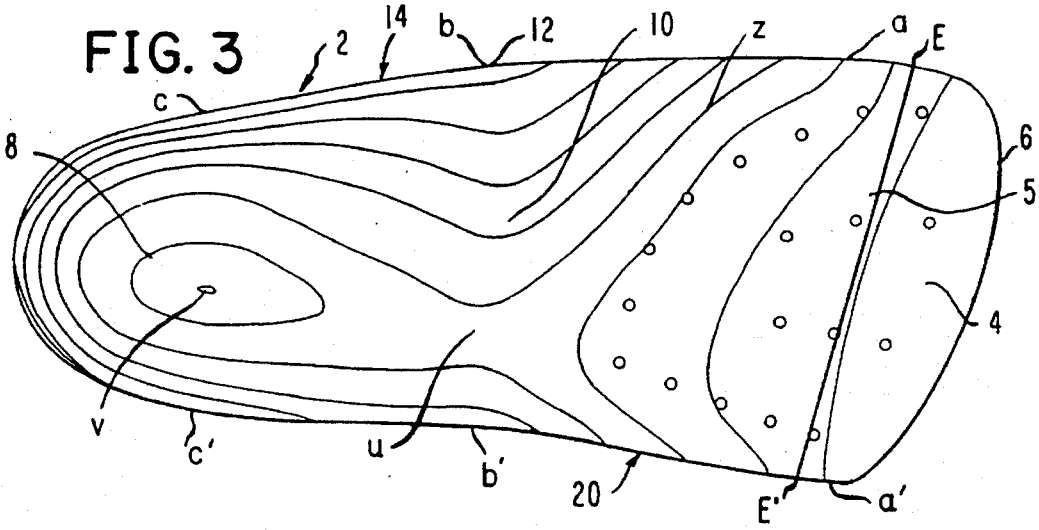
Figure 4A:
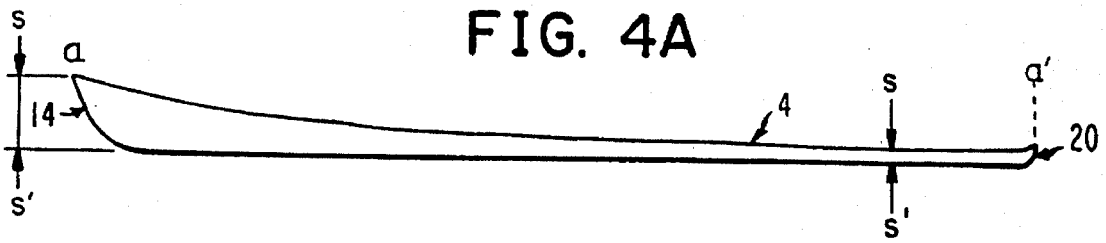
FIGS. 4A, 4B, 4C and 4D show cross sectional views of the insole of FIG. 2 and 3 taken across points a–a', b–b' and c–c', also in view of FIG. 5A and 5B.
Figure 4B:
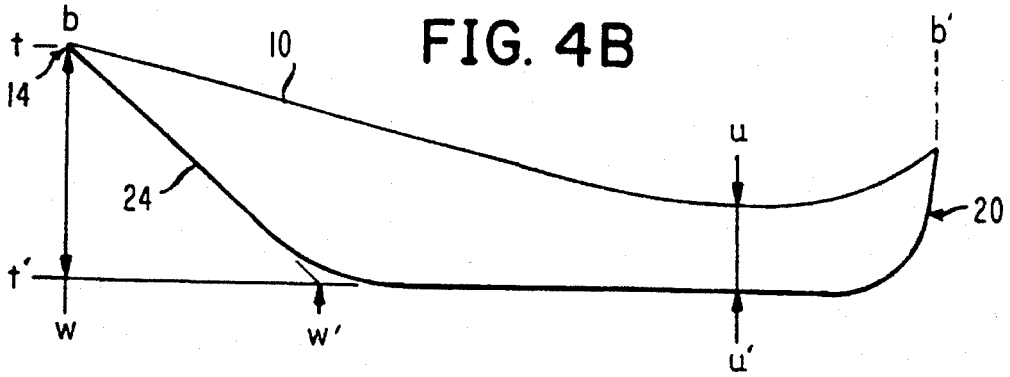
Figure 4C:
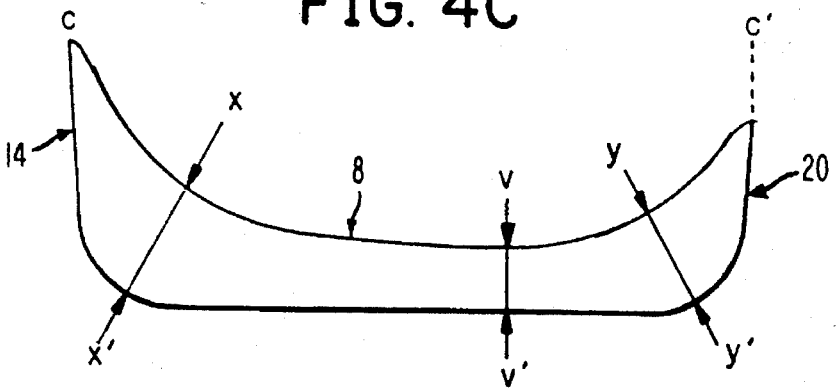
Figure 4D:
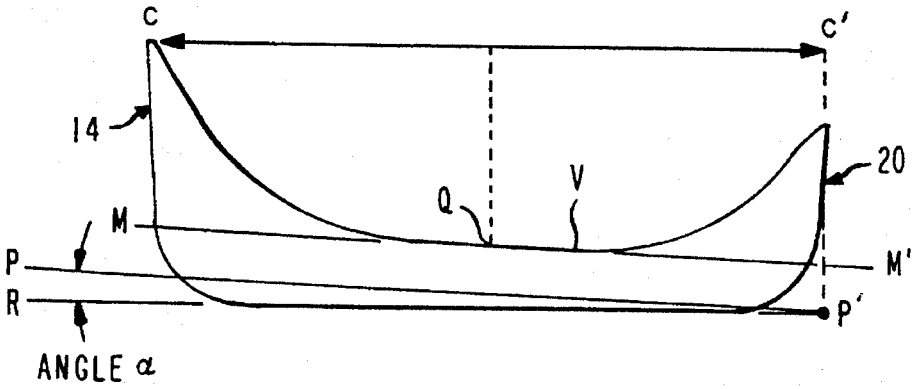
Figure 5A:
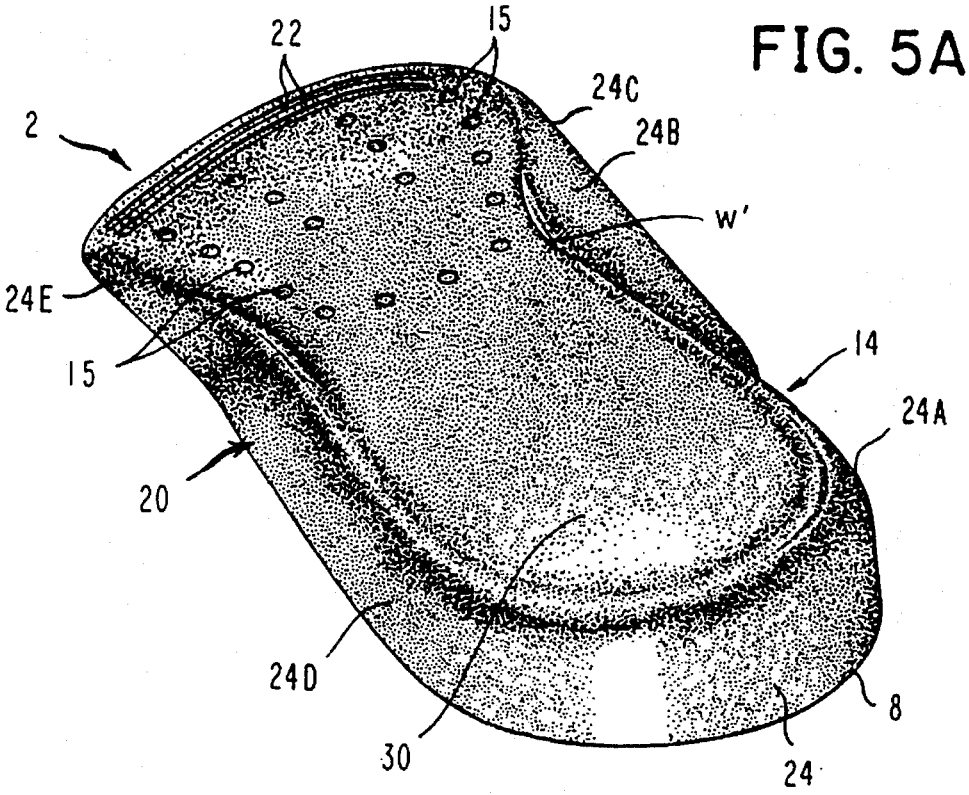
FIG. 5A is a rear end perspective view of the bottom of the insole of FIG. 1.
Figure 5B:
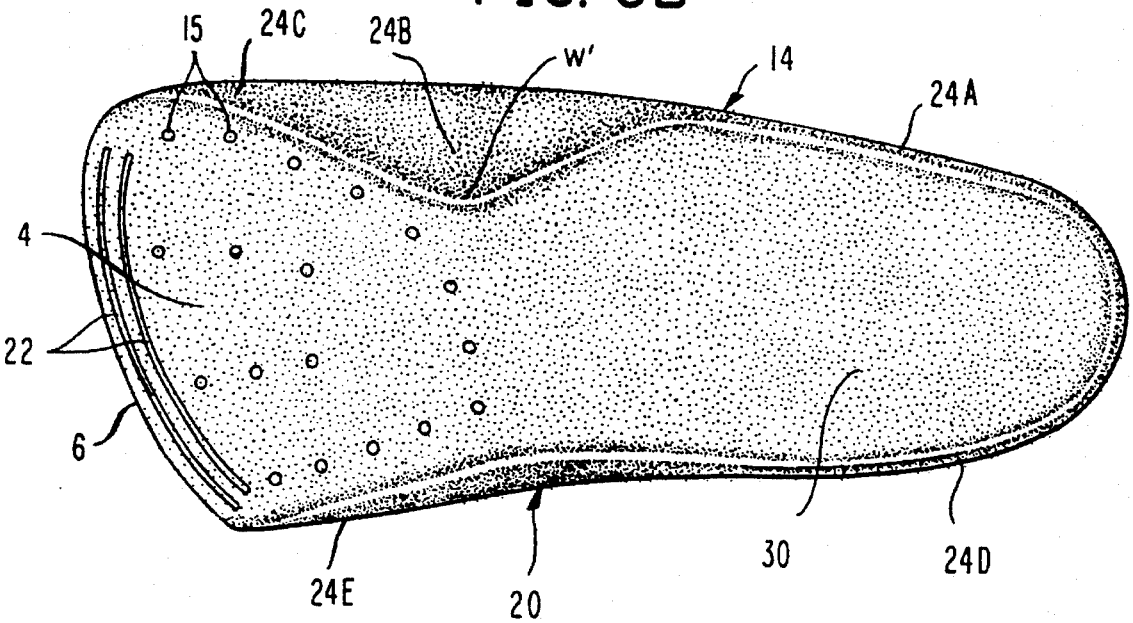
FIG. 5B is bottom plan view of the insole of FIG. 1 showing trim lines in the toe portion.
Figure 10:
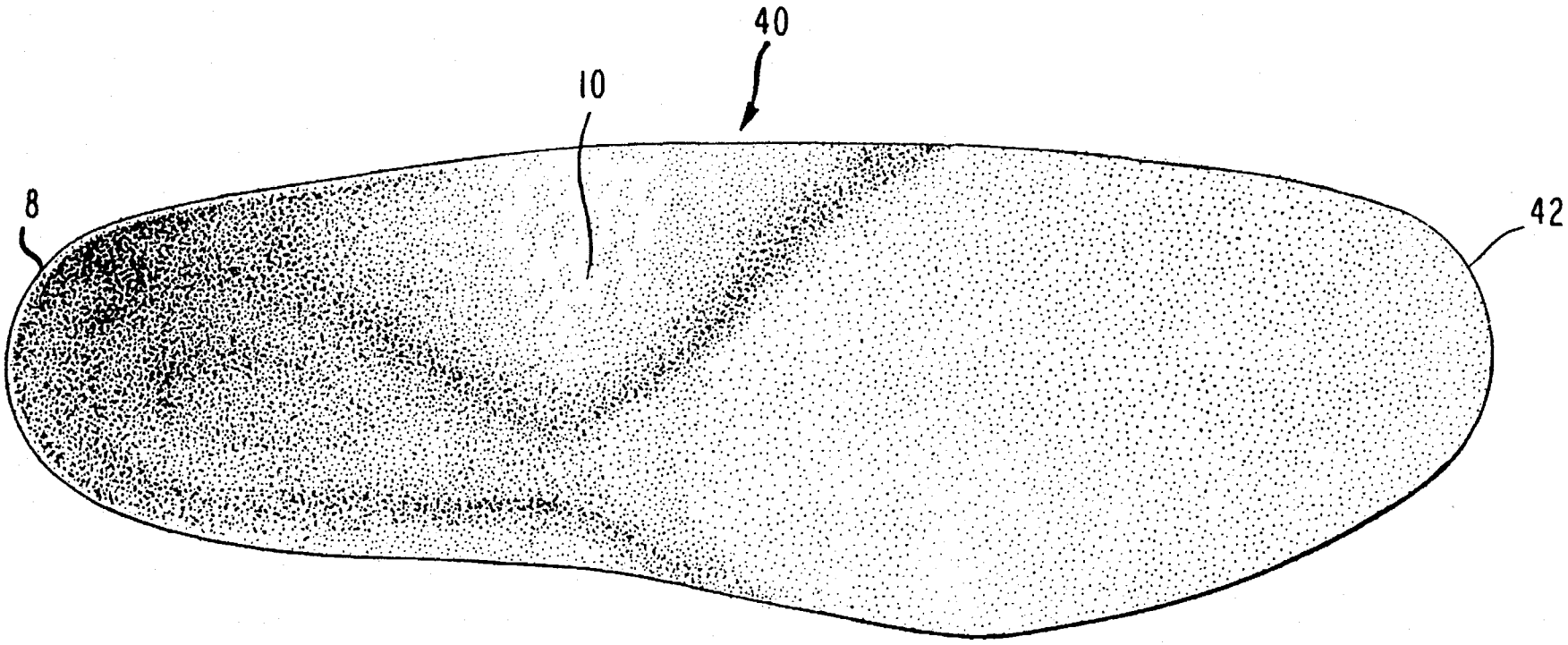
Figure 11:
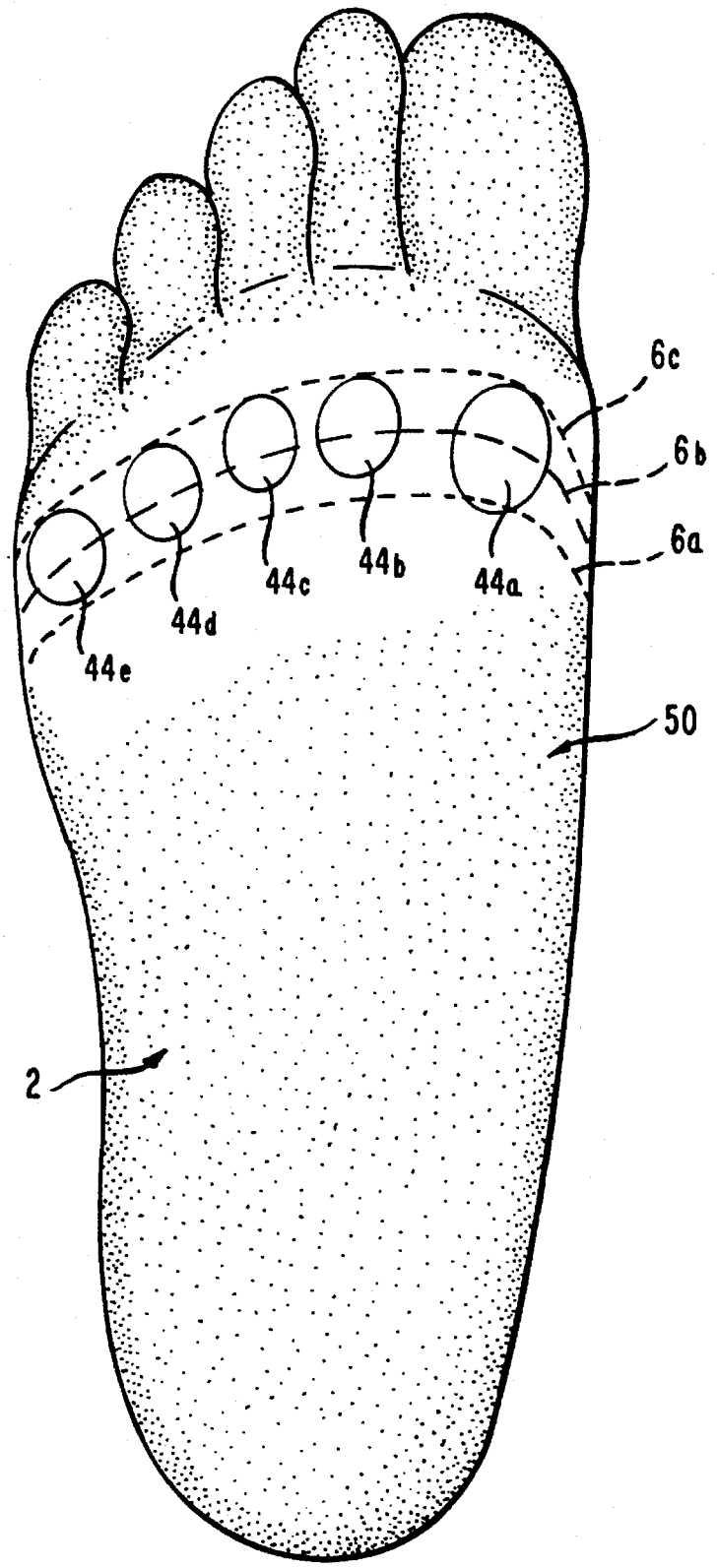
FIG. 11 is a view of the bottom of a foot with the forward edge of the insole of FIG. 1 conceptually in place.
Figure 12:
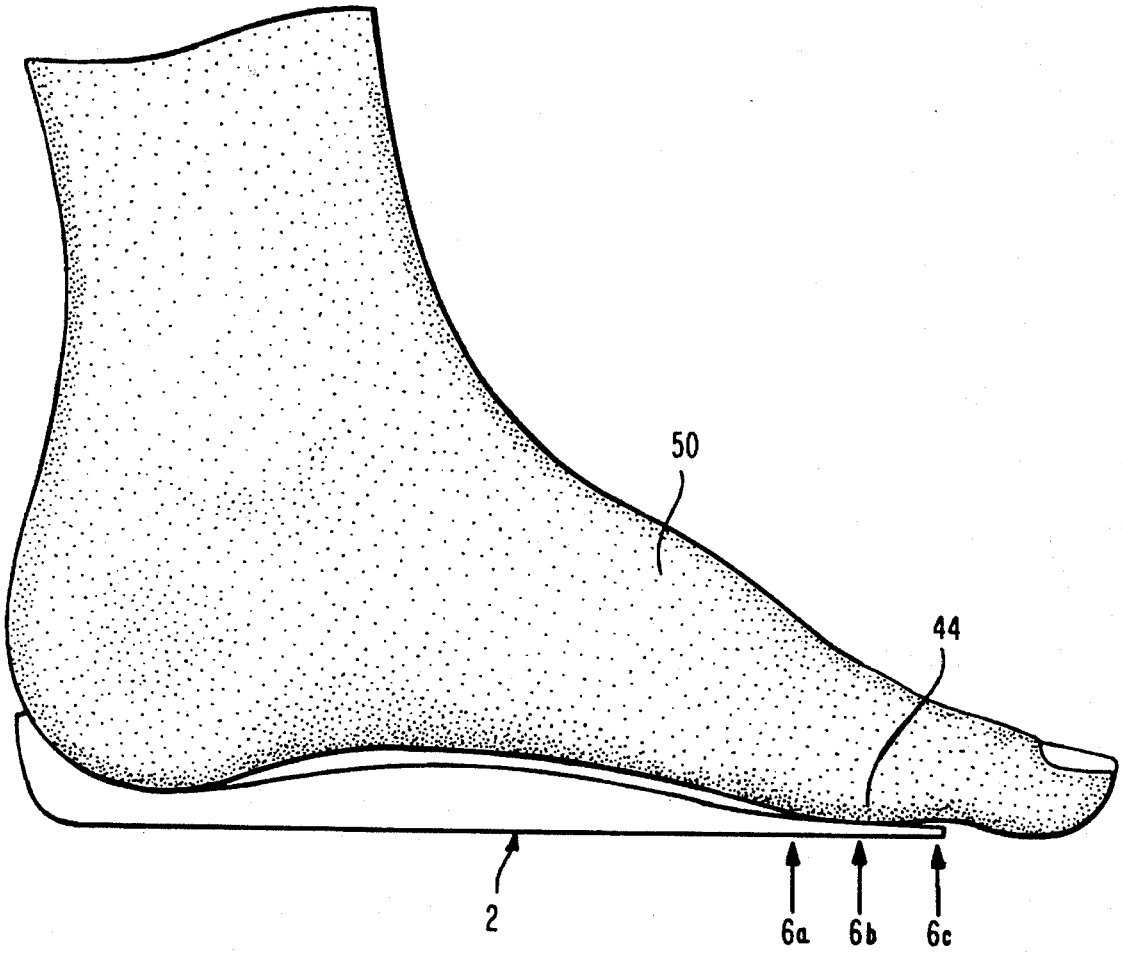
FIG. 12 is a view of the side of a foot atop the insole of FIG. 1.
Figure 13:
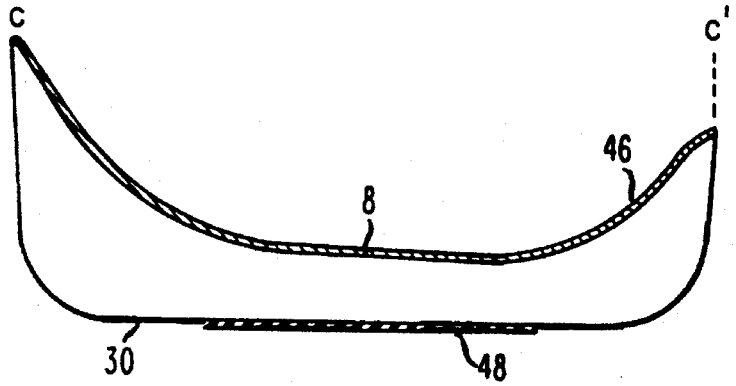
FIG. 13 is a cross sectional view for FIG. 4C showing a top cover and optional double sided pressure sensitive adhesive.
Figure 14:
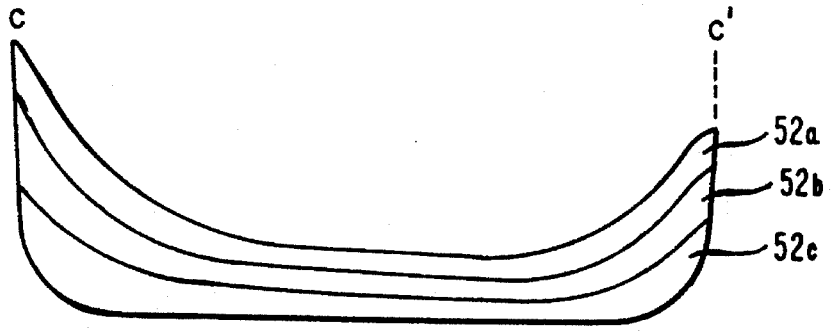
FIG. 14 is a cross sectional view for FIG. 4C showing multilayered composite layers.
Figure 15:
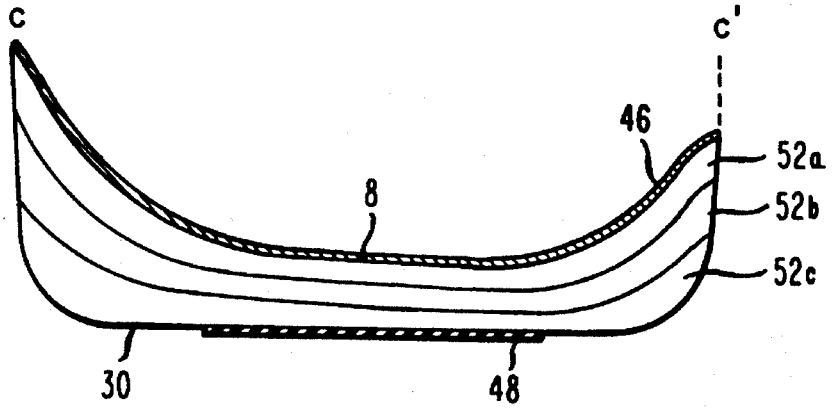
FIG. 15 is a cross sectional view for FIG. 4C showing top cover, a multilayered composite, and a double sided adhesive.

The following table provide dimensions for various portions within a ¾ length insole for normal adult shoe sizes.

| | Ranges for Normal Adult Shoe Sizes in Inches | |
|---|---|---|
| Dimensions | Women's Size | Men's Size |
| Widths(horizontal) | | |
| a–a' | 2.3–3.9 | 2.6–4.4 |
| b–b' | 2.1–3.5 | 2.0–4.0 |
| c–c' | 1.6–2.8 | 1.9–3.1 |
| b–u | 1.6–2.8 | 1.9–3.1 |
| c–v | 1.0–1.8 | 1.2–2.0 |
| Lengths (longitudinal) | | |
| Overall Length(3/4) | 5.5–9.3 | 6.2–10.4 |
| a–b | 1.6–3.1 | 1.8–3.2 |
| b–c | 1.9–3.1 | 2.1–3.5 |
| Thickness (vertical) | | |
| s–s' | 0.04–0.10 | 0.04–0.12 |
| t–t' | 0.31–0.84 | 0.38–0.94 |
| u–u' | 0.12–0.26 | 0.15–0.29 |
| v–v' | 0.17–0.33 | 0.19–0.37 |

EXAMPLE 1

Preparation of Insole

A pre-warmed two-part mold is used having a top core mold half and a bottom cavity mold half. A thin topcover of brushed knit, urethane, scrim laminate fabric is attached to the top core mold half. The bottom cavity, is spray coated with a release coating. After the coating has dried, polyurethane is poured into the bottom cavity and the mold is closed. The foam expands and the part is cured. The part is demolded and die-cut, yielding a molded insole having two layers that are integrally bound into one article. A double sided adhesive tape may be attached to the bottom of each insole to provide a means of holding the insole in place in the shoe.

EXAMPLE 2

Testing of Insole for Relieving Bottom-of-Heel Pain

Subjects were selected who suffered from plantar heel pain or Heel Spur Syndrome (a condition that consists of severe pain when first walking after a period of rest, which subsides quickly as the individual continues to walk, but may return when the foot tires after extended use). The subjects were chosen with plantar heel pain due to plantar fasciitis, heel spurs, heel bruises or high arches. Subjects were adult males or females 18 year of age or older who routinely wore shoes for which the insole is designed (ie. men's dress shoes, work shoes or boots, or women's low heel shoes, flats, loafers, tie style shoes or athletic shoes). Subjects were excluded who had either a painful heel exostosis (outward projecting bony growth on the back of the heel), painful cracked skin on the heel, diabetes, circulatory disorders of the feet, lack of sensation in their feet, or any foot condition which would make it uncomfortable or impossible to wear ¾ length contoured insoles, such as painful bunions, excessively painful corns, etc. Also excluded were subjects wearing specially designed prescription orthotic devices or prescription shoes, or those using any medication which would interfere with product evaluation. One hundred subjects comprised of fifty men and fifty women were provided with a suitably sized insole, taking into account foot length, shoe size and width. Subjects were instructed to wear the insoles for two weeks, at least 5 days per week for at least 6 hours per day, in shoes for which the insole is designed. Subjects then answered a questionaire regarding comfort, fit and pain relief. The overall results are shown in the Table below;

| | % of subjects who liked the insole | % of subjects who reported immediate decreased heel pain | % of subjects who reported effectiveness in relieving heel pain all day | % of subjects who reported improvement in reducing heel pain over the two week study |
|---|---|---|---|---|
| Men | 86 | 82 | 80 | 74 |
| Women | 88 | 80 | 84 | 88 |

The results of the above study indicated that at least 86% of both the men and the women liked the insole. Further, at least 80% of both the men and the women reported immediate decreased heel pain and/or effectiveness in relieving heel pain all day. At the end of the two week study, 74% of the men and 88% of the women had a reduction in their overall level of heel pain without the insole.

EXAMPLE 3

Testing of Insole for Relieving Bottom-of-Heel Pain

A study was conducted under conditions similar as described in Example 2, except that at least 60% of the subjects were to have plantar fasciitis, heel spurs or both as the causative factor of bottom-of-heel pain and the subjects were instructed to wear the insoles for six weeks. The results of this study indicated that 82% of the men and women liked the insole. Further, at least 84% of the men and women noted pain relief within one minute. At the end of the 6-week study, 84% of the subjects had a reduction in their overall level of heel pain. In addition, 34% of the subjects initially had arch pain, in addition to bottom-of-heel pain. Of these, 70% had a reduction in arch pain as well as a reduction in heel pain.

We claim:

1. A removable insole for relieving bottom-of-heel pain and/or arch pain associated with bottom-of-heel pain comprising:

a flexible, shock-absorbing, compressible material having a front portion with a forward edge, a cupped heel portion and a broad, raised arch portion having a maximum height at the medial edge of said insole; wherein said front portion tapers downward from said raised arch portion toward a first minimum thickness on a line positioned behind the metatarsal heads of a foot when the insole is in place in a shoe;

said cupped heel portion is posted medially from about 1 to about 4 degrees so that the medial bottom side of said cupped portion is thicker than the lateral bottom side of said cupped portion;

said insole has a substantially upright wall portion which extends arcuately around said cupped heel portion, wherein starting at the heel end, said wall portion gradually slopes inward on the medial side to a point approximately one-third across the width of the insole, and continues forward while reducing in height along said medial edge to undercut said arch portion and allow a close fit of the undercut arch portion with the arch portion of a shoe, wherein on the lateral side of said insole, said upright wall portion reduces in height from said cupped heel portion to said first minimum thickness in the front portion;

said broad, raised arch portion gradually slopes downward from said maximum point to said first minimum thickness located on a line behind the metatarsal heads, to a second minimum thickness located at about 55 to about 90 percent across the width of said insole from said maximum, raised arch portion and to a third minimum thickness located within said cupped heel portion, wherein said cupped heel portion is thicker than said front portion.

2. The insole of claim 1 wherein said shock-absorbing material is made of polyurethane.

3. The insole of claim 1 wherein the forward edge of said forward portion is disposed behind the metatarsal heads of a foot.

4. The insole of claim 1 wherein said forward portion is disposed in front of said metatarsal heads.

5. The insole of claim 1 wherein said cupped heel portion is medially posted about 1 degree.

6. The insole of claim 1 wherein said cupped heel portion is medially posted between about 2 to 3 degrees.

7. The insole of claim 1 wherein said lateral side begins to substantially decrease in height at a point across the width from said maximum, raised medially arch point to said first mininum thickness in the front portion.

8. The insole of claim 1 wherein said broad, raised medial arch portion gradually decreases to said third minimum thickness located at about 65 to about 85 percent across the width of said insole from said maximum, raised medial arch portion.

9. The insole of claim 1 wherein said broad, raised medial arch portion gradually decreases to said second minimum thickness located at about 75 to about 80 percent across the width of said insole from said maximum, raised medial arch portion.

10. The insole of claim 1 further comprising a topcover bonded to the outer surface of said forward portion, said cupped heel portion and said broad, raised arch portion.

11. The insole of claim 10 wherein the topcover is a fabric.

12. The insole of claim 11 wherein the topcover is a urethane knit laminate.

13. The insole of claim 1 having perforations extending from the top surface to the bottom surface.

14. The insole of claim 1 wherein the bottom surface is flat.

15. The insole of claim 14 wherein the non-slip coating is a double-sided pressure sensitive adhesive tape.

16. The insole of claim 1 wherein the non-slip coating is attached to the bottom surface to reduce movement of the insole within the shoe.

17. The insole of claim 1 which is multilayered.

18. The insole of claim 1 further comprising a small lateral arch portion which leads into the second minimum thickness from the lateral side.

19. The insole of claim 1 which is three-quarters length and extends from the heel to approximately the first metatarsals of the foot.

20. The insole of claim 1 which is full length and extends along the entire length of the foot.

21. A method for relieving bottom-of-heel pain, arch pain associated with bottom-of-heel pain or both types of pain comprising wearing in one's shoes, an insole comprising:

a flexible, shock-absorbing, compressible material, having a front portion with a forward edge, a cupped heel portion and a broad, raised arch portion having a maximum height at the medial edge of said insole; wherein said front portion tapers downward from said raised arch portion toward a first minimum thickness on a line positioned behind the metatarsal heads of a foot when the insole is in place in a shoe;

said cupped heel portion is posted medially from about 1 to about 4 degrees so that the medial bottom side of said cupped portion is thicker than the lateral bottom side of said cupped portion;

said insole has a substantially upright wall portion which extends arcuately around said cupped heel portion, wherein starting at the heel end, said wall portion gradually slopes inward on the medial side to a point approximately one-third across the width of the insole, and continues forward while reducing in height along said medial edge to undercut said arch portion and allow a close fit of the undercut arch portion with the arch portion of a shoe, wherein on the lateral side of said insole, said upright wall portion reduces in height from said cupped heel portion to said first minimum thickness in the front portion;

said broad, raised arch portion gradually slopes downward from said maximum point to said first minimum thickness located on a line behind the metatarsal heads, to a second minimum thickness located at about 55 to about 90 percent across the width of said insole from said maximum, raised arch portion and to a third minimum thickness located within said cupped heel portion, wherein said cupped heel portion is thicker than said front portion.

* * * * *